US007287883B1

(12) United States Patent
Plunk et al.

(10) Patent No.: US 7,287,883 B1
(45) Date of Patent: Oct. 30, 2007

(54) YIELDING HANGER FOR STEM MOUNTING FLUORESCENT HIGHBAYS

(75) Inventors: Carlton Bruce Plunk, Saltillo, MS (US); William Bradley Waycaster, Tupelo, MS (US)

(73) Assignee: Genlyte Thomas Group, LLC, Louisville, KY (US)

( * ) Notice: Subject to any disclaimer, the term of this patent is extended or adjusted under 35 U.S.C. 154(b) by 113 days.

(21) Appl. No.: 11/180,844

(22) Filed: Jul. 13, 2005

Related U.S. Application Data

(60) Provisional application No. 60/618,159, filed on Oct. 13, 2004.

(51) Int. Cl.
*F21S 8/06* (2006.01)

(52) U.S. Cl. ..... 362/404; 362/148

(58) Field of Classification Search ..... 362/260, 362/404

See application file for complete search history.

(56) References Cited

U.S. PATENT DOCUMENTS

| | | | | |
|---|---|---|---|---|
| 2,291,490 | A | 7/1942 | Naysmith | |
| 2,291,491 | A * | 7/1942 | Naysmith | 362/221 |
| 2,297,869 | A * | 10/1942 | Biller | 248/343 |
| 2,347,113 | A | 4/1944 | King | |
| 2,433,819 | A | 12/1947 | Scribner | |
| 2,532,528 | A | 12/1950 | Zuley | |
| 2,543,713 | A | 2/1951 | Yeager | |
| 2,559,641 | A | 7/1951 | Kruger | |
| 2,632,620 | A | 3/1953 | Hurley | |
| 2,736,528 | A | 2/1956 | Le Brock | |
| 2,762,598 | A | 9/1956 | Runge | |
| 2,837,631 | A * | 6/1958 | Eberhard et al. | 362/225 |
| 2,913,214 | A | 11/1959 | Stahlhut | |
| 2,936,991 | A * | 5/1960 | Picha et al. | 248/343 |
| 3,329,811 | A * | 7/1967 | Pascucci et al. | 362/225 |
| 4,219,868 | A | 8/1980 | Bowman et al. | |
| 5,282,600 | A | 2/1994 | Weiss et al. | |
| 5,526,244 | A | 6/1996 | Bishop | |
| 6,123,435 | A | 9/2000 | Wang | |
| 6,428,183 | B1 | 8/2002 | McAlpin | |
| 6,517,222 | B1 | 2/2003 | Orlov | |
| 7,070,303 | B2 * | 7/2006 | Kassay et al. | 362/260 |
| 2002/0080606 | A1 | 6/2002 | Yaphe et al. | |
| 2004/0008518 | A1 | 1/2004 | Wu et al. | |
| 2004/0151001 | A1 | 8/2004 | Wu | |

FOREIGN PATENT DOCUMENTS

| | | |
|---|---|---|
| DE | 3520741 | 5/1987 |

* cited by examiner

*Primary Examiner*—Hargobind S. Sawhney
(74) *Attorney, Agent, or Firm*—Steven Alan Witters; Middleton Reutlinger

(57) ABSTRACT

A yielding hanger for a luminaire comprising a rectangular top having a centrally located mounting hole, two opposing sides, two opposing ends, and a plurality of hanger legs depending downwardly from the top. The hanger legs have a length, width, thickness, and composition of material to provide for the absorption of physical shock by springing or bending.

12 Claims, 6 Drawing Sheets

YIELDING HANGER FOR STEM MOUNTING FLUORESCENT HIGHBAYS

CROSS-REFERENCE TO RELATED APPLICATIONS

This application claims the benefit of U.S. Provisional Patent Application No. 60/618,159, filed Oct. 13, 2004, the entire disclosure of which is incorporated herein by reference.

STATEMENT REGARDING FEDERALLY SPONSORED RESEARCH OR DEVELOPMENT

Not applicable.

BACKGROUND OF THE INVENTION

1. Technical Field of the Invention The present invention relates to electric lighting fixtures and particularly a means for mounting fluorescent luminaires such as high bay luminaires. More particularly, the present invention relates to a yielding hanger attaching a high bay fluorescent light fixture to a ceiling or conduit vertically depending therefrom, wherein the yielding hanger is formed to provide a means for absorbing physical impact or shock.

2. Description of the Related Art

High Bay luminaires are rather large and consequently difficult to securely mount to a ceiling area. The large size of the fluorescent highbays cause the luminaire to be unstable when mounted by a single stem. Any slight hit or physical contact with the luminaire can cause misalignment or even allow the pendant or conduit to unscrew itself from the luminaire.

For example U.S. Pat. No. 2,433,819, issued to Scribner, teaches a yielding hanger for a fluorescent luminaire, wherein the hanger is comprised of rectangular top having a centrally located mounting hole and depending legs extending downward from each side of the rectangular top. Each of the depending legs has a horizontally oriented slot for receiving protrusions on the lamp housing. The depending legs in Scribner do not have a shock absorbing feature, and consequently physical shock such as being inadvertently hit can cause damage to the luminaire, cause the luminaire to become unscrewed from the post mount, or damage the conduit or post.

In the prior art, a shock absorbing feature typically includes suspending the luminaire from the ceiling area by a cable or cables. In the event of inadvertent contact, the luminaire simply swings to the side and thus prevents breakage of the luminaire or luminaire mount. However, a cable mount causes the luminaire to stay in motion after physical contact and requires attaching cables to the ceiling surface itself which entails additional hardware and labor that single stem or post mounting does not require.

SUMMARY OF THE INVENTION

It is an object of the present invention to provide a means for absorbing physical shock that may be inadvertently placed on a luminaire. The invention is especially adaptable to fixtures for tubular fluorescent lamps such as high bay luminaires.

Another object of the present invention to provide means for returning the luminaire to an operating position upon the removal of a minor contacting force.

A further object of the invention is to provide a small compact fixture retaining unit to be yieldingly attached to conduit depending from a ceiling area and upon which a completely assembled high bay luminaire is hung thus facilitating the installation of high bay fixtures.

Yet another object of the invention is to provide a luminaire supporting unit which is relatively low in cost and effective in operation.

Other objects and features of the invention will more fully appear from the following description in connection with the accompanying drawings and will be particularly pointed out in the claims.

The presently claimed invention is a yielding shock absorbing hanger for single stem mounting high bay luminaires. In one embodiment, the hanger is comprised of a rectangular top having a centrally located mounting hole and narrow depending legs extending downward from each corner of the rectangular top. The centrally located mounting hole may be threaded wherein it is threaded onto conduit depending from the ceiling area. Additionally, a lock nut may be placed on the threaded conduit above and/or below the rectangular top thus securing the yielding hanger onto the conduit. In a preferred embodiment, each of the depending legs has a specific dimension, orientation, and composition of material to provide for a shock absorbing spring and/or shock absorbing retaining bend. For installing and retaining the luminaire to the legs of the hanger, each leg may have an inward extending tab and terminate with an outward and upward extending flange. The tabs act as a stop against the top of the luminaire housing when the legs are inserted into slots in the top of the luminaire housing. When the tabs encounter the top of the luminaire, the flanges extend through slots in the sides of the luminaire housing thus suspending the luminaire from the yielding hanger. Optionally, between the tab and flange on each leg there is a hole for receiving a lamp housing mounting screw. A screw is placed through a hole in the side of the luminaire and into each leg thus securing the luminaire to the yielding hanger.

The hanger legs act as a "crush zone" when the luminaire is hit violently. The legs collapse before the threaded pipe or conduit starts to unscrew from the hanger. In the event light hits are received by the luminaire, the hanger legs act as a spring and allow the fixture to return to the original position and alignment almost immediately upon removal of the contacting force.

DETAILED DESCRIPTION OF THE PREFERRED EMBODIMENTS

To present a better understanding of the invention, a particular embodiment thereof will now be described and illustrated in the figures. Reference to the Figures showing an embodiment of the presently claimed invention is made to describe the presently claimed invention and not to limit the scope of the claims herein.

Figure 1:
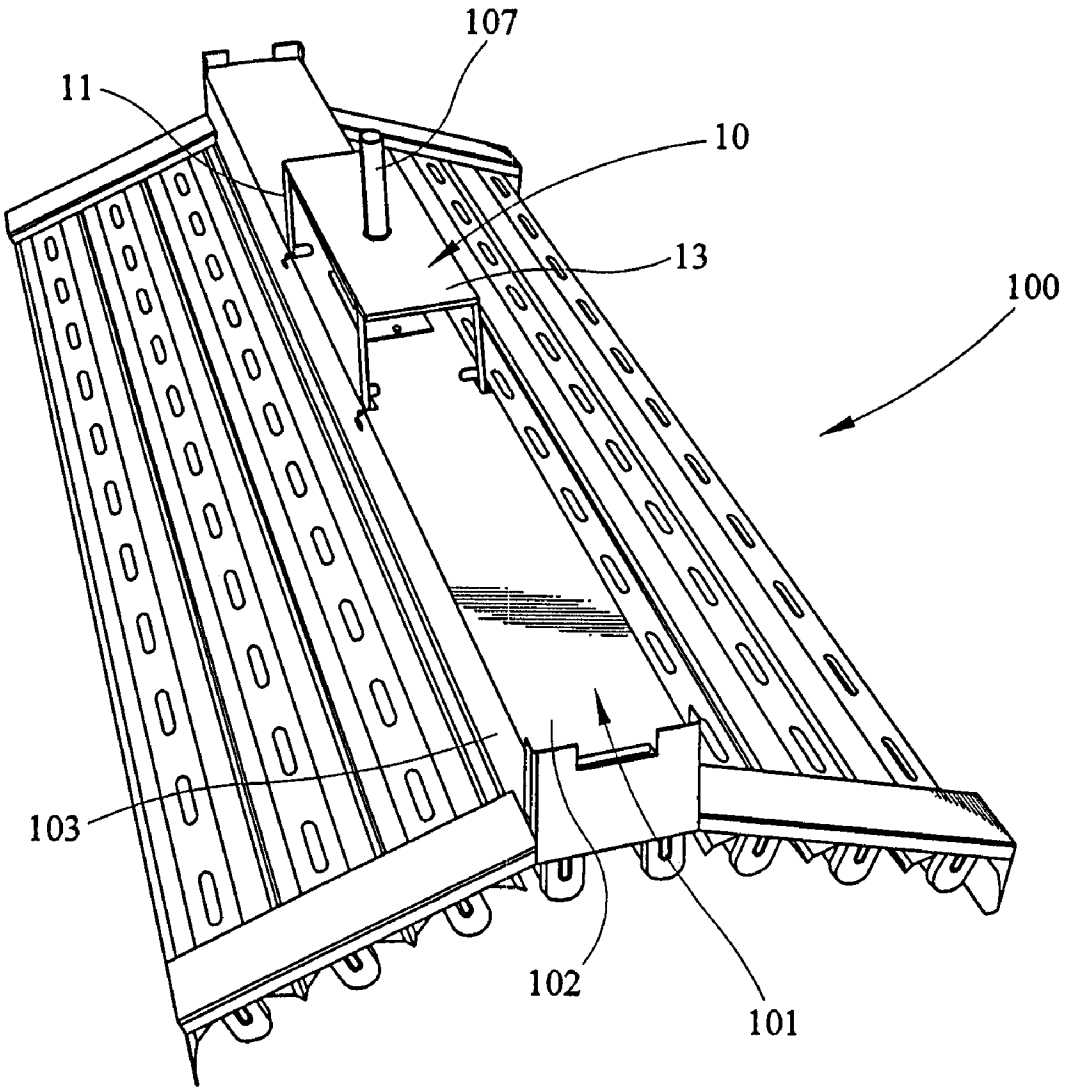
FIG. 1 is a perspective view of an embodiment of the present invention showing the yielding hanger stem mounted on conduit and attached to a high bay luminaire.

FIG. 1 is a perspective view of an embodiment of the presently claimed invention showing the yielding hanger 10 stem mounted on conduit 107 and attached to a high bay luminaire 100. Rectangular top 13 is single stem or post mounted to conduit 107. A plurality of depending shock absorbing legs 11 extend downward from rectangular top 13. Shock absorbing legs 11 are of a specific length, width, thickness, and composition of material to absorb shock by having a springing and/or bending characteristic. Shock absorbing legs 11 attach to a multiple lamp fluorescent luminaire of high bay type 100 having a housing channel 101. Housing channel 101 has an elongated top wall 102 and elongated side walls 103.

Figure 2:
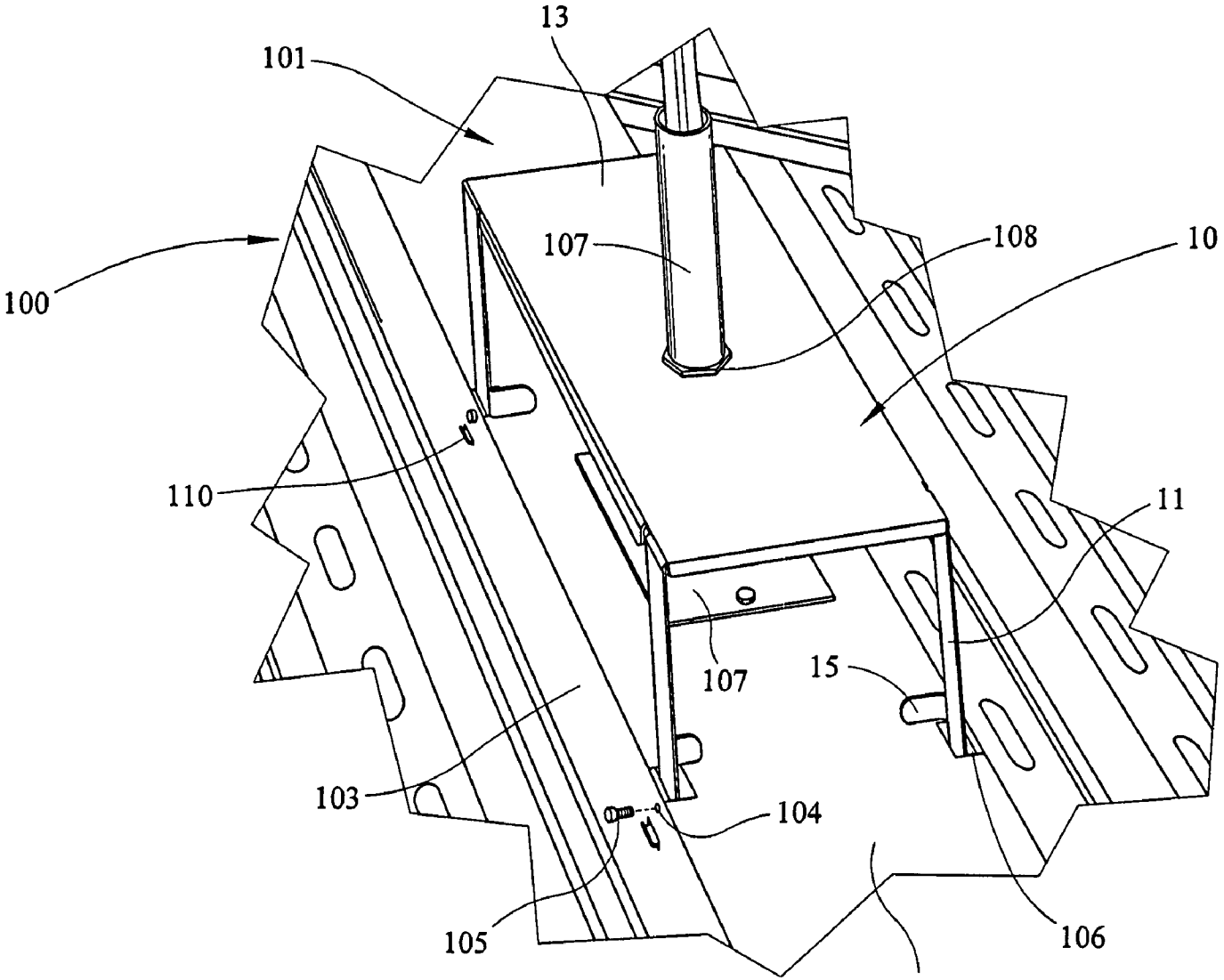
FIG. 2 is an enlarged perspective view of the yielding hanger of FIG. 1 showing the yielding hanger attached to a luminaire wherein the luminaire is shown in a cut away view.

FIG. 2 is an enlarged perspective view of the yielding hanger 10 showing a cutaway view of the luminaire 100 and mounting conduit 107 to which it is attached. Yielding hanger 10 has top wall 13 and four depending shock absorbing legs 11. Top wall 13 is threadingly engaged with threaded conduit pipe 107 and lock nut(s) 108. Extending downward from top wall 13 are hanger legs 11. In this embodiment, yielding hanger 10 has four hanger legs 11 where each hanger leg 11 extends downward from an end of the elongated sides of yielding hanger 10. Each hanger leg 11 has an inward extending mounting tab 15 that aids in installing hanger legs 11 to channel 101. Tabs 15 encounter channel top wall 102 when hanger legs 11 are inserted into channel through slots 106 in channel top wall 102. This encounter aids in installation by preventing hanger legs 11 from over extending into channel 101. Channel side walls 103 have mounting holes 104 below channel through slots 106 and mounting slots 110 below mounting holes 104. When hanger legs 11 are inserted into channel through slots 106, outwardly extending flanges 17 (shown if FIG. 3) extend through mounting slots 110. Having flanges 17 in mounting slots 110 holds luminaire 100 to yielding hanger 10 for installation. Screws 105 are inserted into mounting holes 104 where they matingly engage hanger legs 11. Other attachment means such as spot welding, riveting, clasping, or other attaching means know to a person of ordinary skill in the art are within the scope of the present invention.

Also shown here is access plate 111 which is recoverably attached to channel top wall 102 and provides access to luminaire 100 wiring (not shown). In this type of stem mounting the power feeding wires are led through the stem or conduit 107 in the usual manner and thence into luminaire housing channel 101 through access plate 111. The necessary power supply leads are fed out and connected to the input leads for the luminaire. The wiring for the luminaire is conventional and it is not believed necessary to illustrate it in the Figures.

Figure 3:
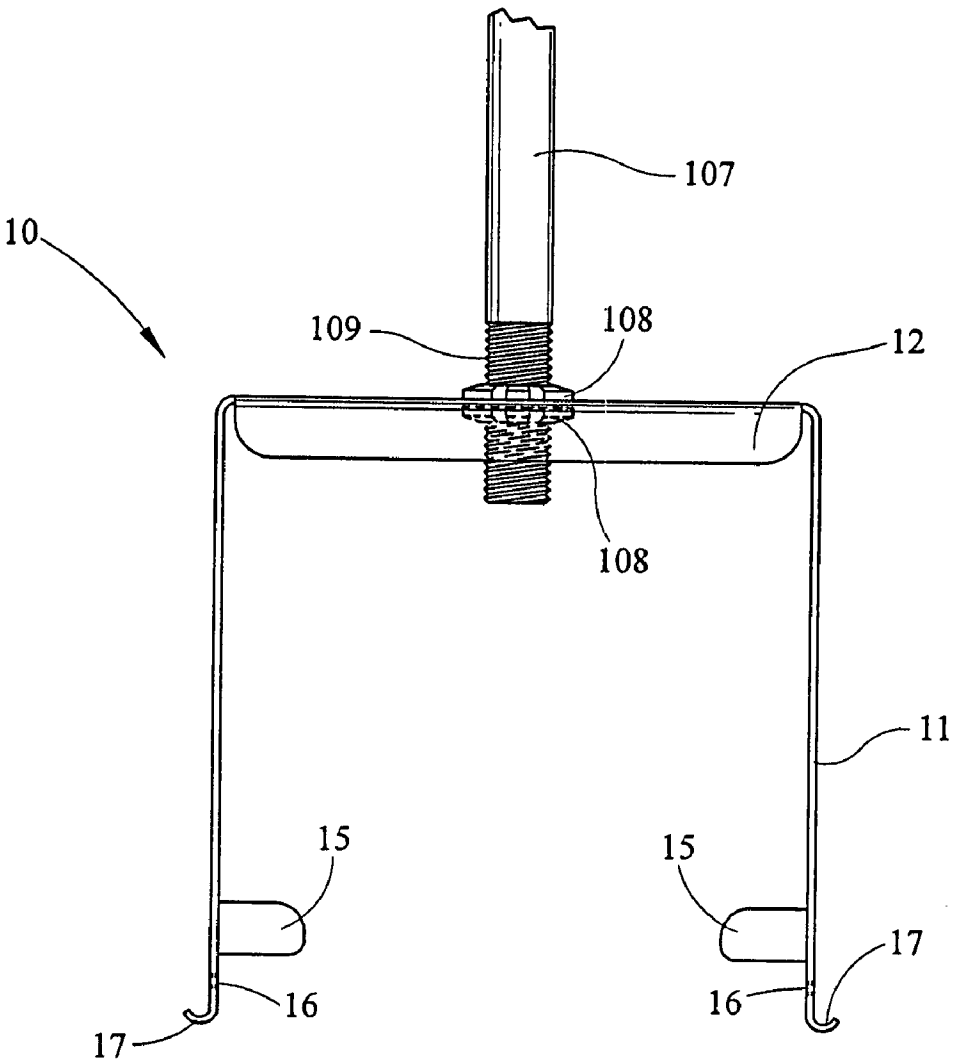
FIG. 3 is an end view of the yielding hanger of FIG. 1 showing the yielding hanger mounted to conduit.

FIG. 3 is an end cutaway view of yielding hanger 10 mounted to threaded conduit pipe 107. Single stem mounting may be accomplished by threading top lock nut 108 onto threads 109 of conduit 107. Hanger 10 is threaded onto conduit 107 and bottom lock nut 108 is then threaded onto conduit 107. Optionally, hanger top wall 13 having a centrally located hole 14 (shown in FIG. 4) may be threaded or not. If not threaded, top and bottom lock nuts 108 may be used to install without the need for threading hanger 10 onto conduit 107, but by simpley placing hanger 10 onto conduit 107. Also shown here is end structural support form 12 which extends downward from each end of top wall 13 and hanger legs 11 which extend downward from each edge of the sides of top wall 13. When yielding hanger 10 is installed onto luminaire 100, the ends of top wall 13 are in a latitudinal configuration with respect to luminaire 100 (not shown) while the sides are in a longitudinal configuration with respect to luminaire 100. Hanger legs 11 have inward depending tabs 15, screw holes 16, and end with upwardly and outwardly depending flange 17.

Figure 4:
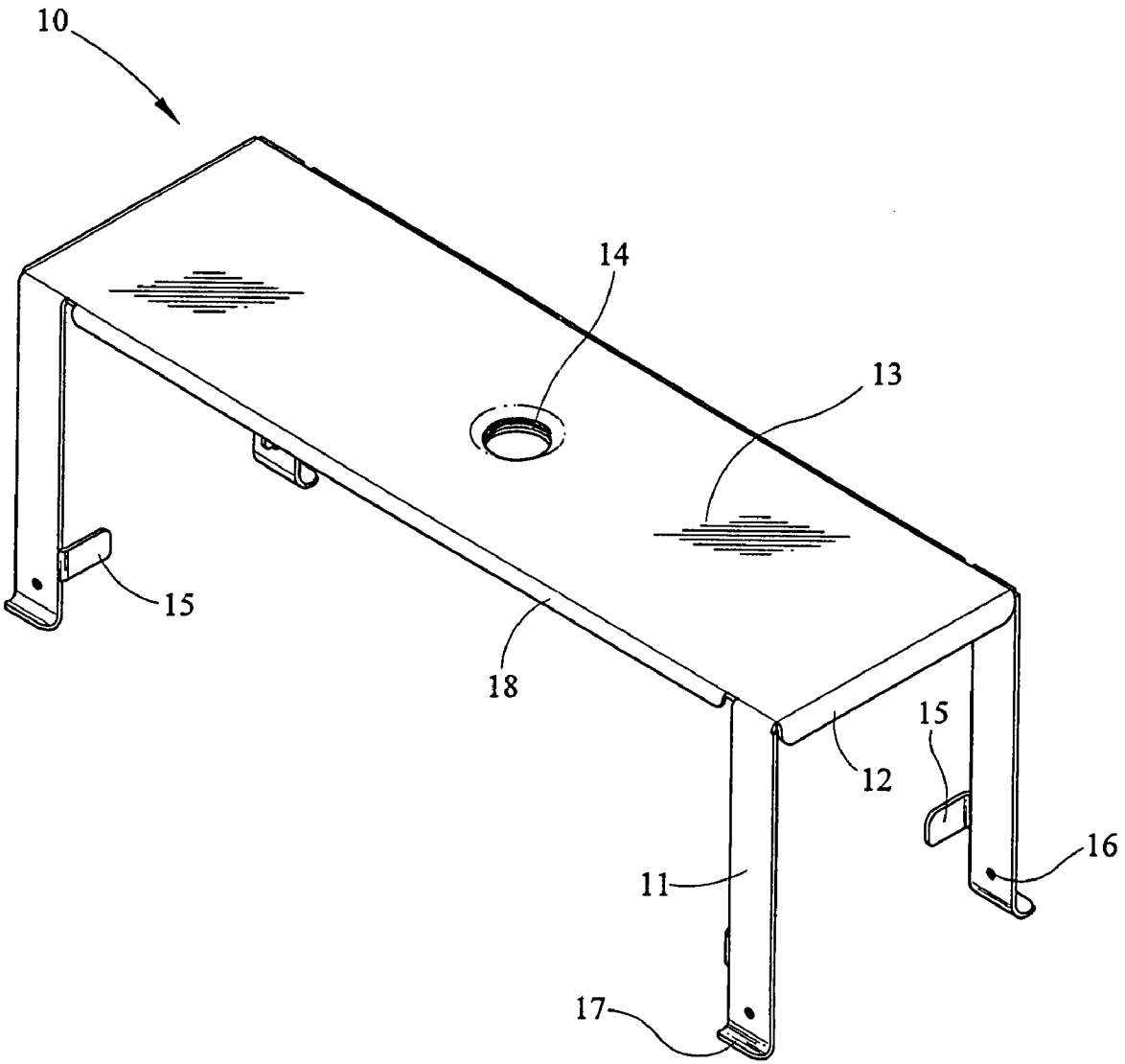
FIG. 4 is a perspective view of the yielding hanger of FIG. 1.

FIG. 4 is a perspective view of the yielding hanger 10 showing each structural feature of an embodiment of the present invention claimed herein. Top wall 13 has centrally located mounting hole 14 for receiving conduit threads 109. Optionally, mounting hole 14 may be threaded as shown. The ends of top wall 13 extend downward with structural support forms 12 while the sides of topwall 13 extend downward with structural support forms 18. Hanger legs 11 extend downward from each edge of the sides of top wall 13. Hanger legs 11 have inward depending tabs 15, screw holes 16, and end with flange 17. Referring to FIG. 2, flange 17 extends outward and upward and cooperates with channel through slots 106 to suspend luminaire 100 while screws 105 extended through mounting holes 104 into screw holes 16.

Figure 5:
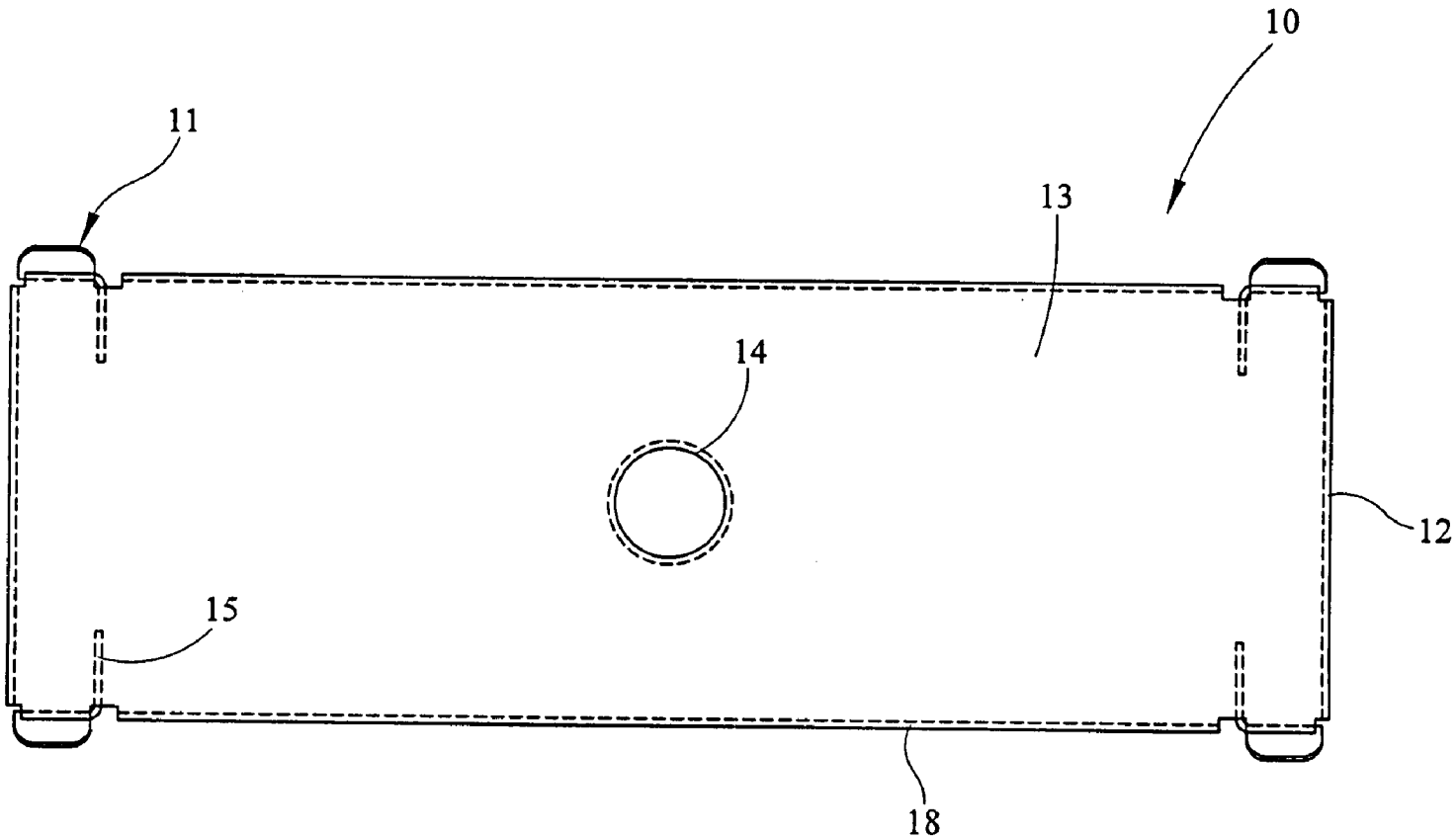
FIG. 5 is a top view of the yielding hanger of FIG. 1.

FIG. 5 is a top view of yielding hanger 10 showing threaded mounting hole 14 centrally located in top wall 13. Also shown here are side support forms 18 and end support forms 12. Hanger legs 11 are shown extending downward and having inward extending tabs 15.

Figure 6:
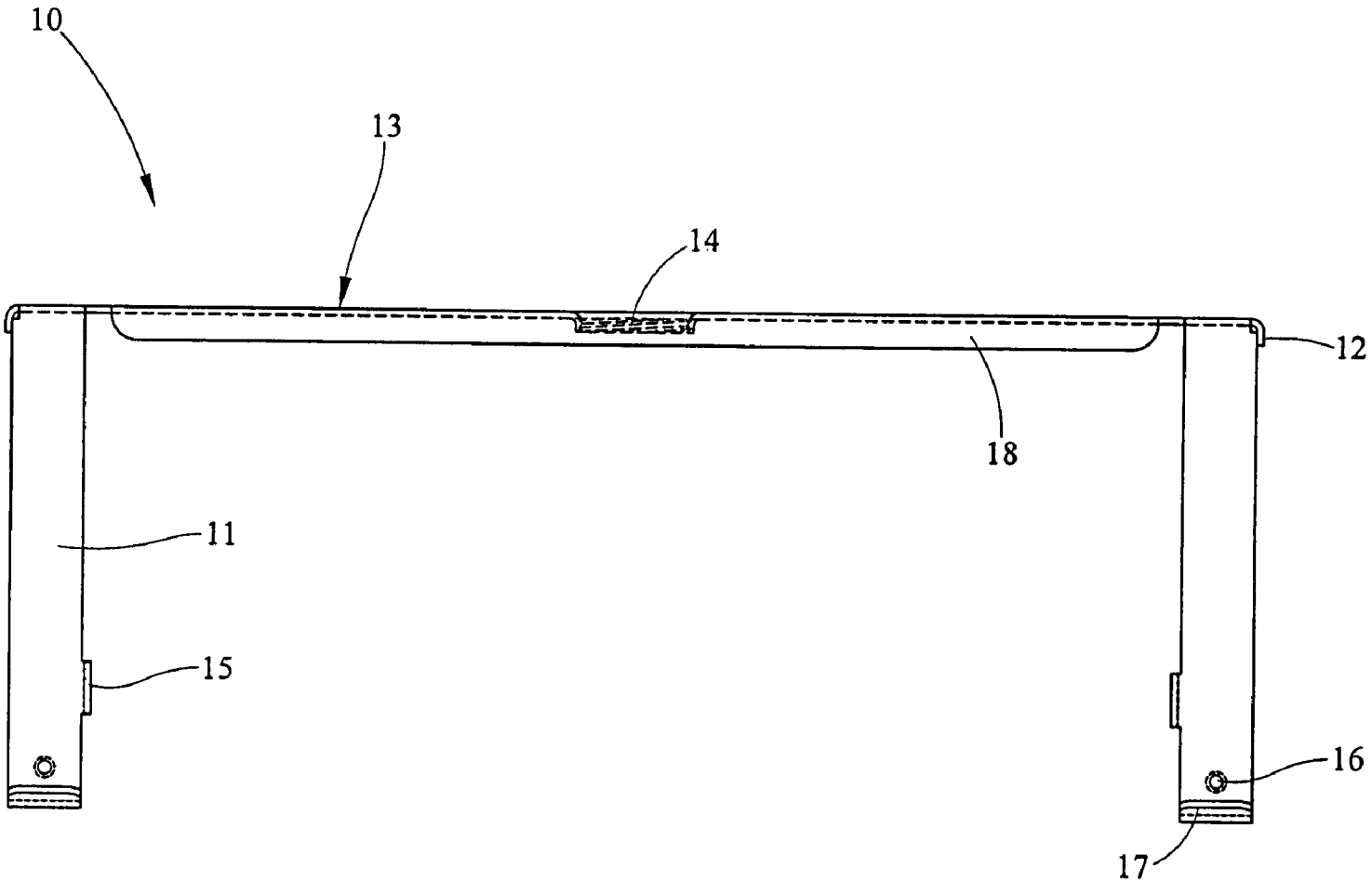
FIG. 6 is a side view of the yielding hanger of FIG. 1.

FIG. 6 is a side view of the yielding hanger 10 showing side support bend 18 and hanger legs 11 extending downward from the sides of yielding hanger 10. Also shown are centrally located threaded mounting hole 14, end support form 12, tabs 15 depending inwardly from hanger legs 11, optionally threaded screw holes 16 in hanger legs 11 between tabs 15 and inwardly and upwardly depending flanges 17.

The yielding hanger of the presently claimed invention provides for a shock absorbing single stem mount of a high bay luminaire. In a preferred embodiment, the whole installation operation of the high bay luminaire may be executed by a single individual. The shock absorbing capacity of the presently claimed invention is accomplished by having a plurality of downwardly depending legs wherein the legs are of a specific height, width, thickness, shape, and composition of material so that the legs spring and/or bend prior to the bending of the conduit or unscrewing of the yielding hanger from the conduit. Installation of the yielding hanger may be accomplished by screwing a lock nut on the conduit threads, screwing the yielding hanger onto the conduit, and screwing a second lock nut onto the conduit. The luminaire is then attached to the yielding hanger by inserting the shock absorbing legs into slots in the top of the luminaire until stop tabs on the legs become adjacent to the top of the luminaire. At this point, outward extending flanges on the legs align with slots in the sides of the luminaire and project through the slots thus hanging the luminaire. Screws are then inserted into holes in the sides of the luminaire and threadingly engaged with the yielding hanger legs thus securing the luminaire to the conduit. Upon installation, the shock absorbing legs of the yielding hanger spring to absorb light physical shock placed on the luminaire and bend to absorb heavy physical shock placed on the luminaire.

It is to be understood that embodiments of the present invention may vary from the figures and description while being within the claimed subject matter. For instance, the top wall may be round or oblong, the hanger legs may be tapered, the hanger legs may not terminate with hanging flonges, etc., and the hanger will still be within the scope of the presently claimed invention.

We claim:

1. A yielding hanger for a luminaire comprising:

A top having a centrally located mounting hole, two opposing sides, two opposing ends, and at least four corner hanger legs depending downwardly from said top, said hanger legs having a length, width, thickness, and composition of material to provide absorption of physical shock by spring, bending, or both at a predetermined force, protecting said luminaire from said physical shock, each of said legs having an inward projecting tab and an outwardly and upwardly extending flange.

2. The yielding hanger of claim 1 wherein said mounting hole in said top is threaded.

3. The yielding hanger of claim 1 wherein said hanger legs have a width not exceeding half of the length of said side of said top.

4. The yielding hanger of claim 1 wherein each of said legs has a housing mounting hole.

5. The yielding hanger of claim 4 wherein each of said housing mounting holes are threaded.

6. The yielding hanger of claim 1 wherein each of said opposing sides of said top has a downwardly extending support form.

7. The yielding hanger of claim 1 wherein each of said opposing ends of said top has a downwardly extending support form.

8. In combination of an electric lighting luminaire having an elongated generally rectangular housing with a top channel having a top wall and two opposing side walls, a supporting unit therefore, said supporting unit comprising a substantially flat horizontal top having at least four depending flexible luminaire corner supporting legs laterally spaced to embrace said channel and extending in spaced relation along said side walls thereof; each of said legs having an inward projecting tab cooperable with said top wall of said lumninaire and terminating with an outwardly and upwardly extending flange, and, a means for yieldingly securing said flexible luminaire supporting legs to said side walls.

9. The combination of the electric lighting luminaire and supporting unit of claim 8 wherein said securing means is a screw that secures said flexible depending luminaire supporting legs to said two opposing channel side walls.

10. The combination of the electric lighting luminaire and supporting unit of claim 8 wherein said top wall of said top channel has a plurality of through slots in spatial relation to said supporting legs, said securing means further incorporates inserting said flanges into said channel through slots in said top wall of said channel.

11. A hanger for an elongated luminaire comprising:

a rectangular top having a centrally positioned mounting hole; and a plurality of impact absorbing hanger legs extending downward from said top, said plurality of impact absorbing hanger legs having a length, width, thickness, and composition of material providing absorption of impact by spring, bending, or both at a predetermined force, protecting said luminaire from said impact each of said hanger legs having an inwardly projecting tab and an upwardly and outwardly extending flange.

12. The hanger of claim 11 wherein said mounting hole is threaded to matingly engage a conduit thread.

* * * * *